US005650202A

United States Patent [19]

Mammone et al.

[11] Patent Number: 5,650,202

[45] Date of Patent: Jul. 22, 1997

[54] METHOD FOR FORMING A PLATINUM COATING ON NON-CODUCTIVE SUBSTRATES SUCH AS GLASS

[75] Inventors: Robert J. Mammone, South Plainfield, N.J.; Deryn D. Chu, Havertown, Pa.; Michael Binder, Brooklyn, N.Y.

[73] Assignee: The United States of America as represented by the Secretary of the Army, Washington, D.C.

[21] Appl. No.: 683,443

[22] Filed: Jul. 18, 1996

[51] Int. Cl.[6] ..... H05H 1/00

[52] U.S. Cl. ..... 427/536; 427/577; 427/430.1; 427/443.1; 427/443.2

[58] Field of Search ..... 427/536, 577, 427/430.1, 443.1, 443.2

[56] References Cited

U.S. PATENT DOCUMENTS

| | | | |
|---|---|---|---|
| 4,379,034 | 4/1983 | Rogers | 204/98 |
| 4,379,772 | 4/1983 | Solomon et al. | 264/49 |
| 4,440,617 | 4/1984 | Solomon | 204/290 R |
| 4,518,705 | 5/1985 | Solomon et al. | 502/101 |
| 5,328,782 | 7/1994 | Binder et al. | 429/101 |
| 5,500,201 | 3/1996 | Binder et al. | 423/449.2 |

*Primary Examiner*—Benjamin Utech

*Attorney, Agent, or Firm*—Michael Zelenka; George B. Tereschuk

[57] ABSTRACT

Methods of forming a platinum deposit on a nonconductive substrate are disclosed, comprising the steps of hydrophobically treating a carbon black powder, forming a solution of chloroplatinic acid, suspending the hydrophobically treated carbon black powder in the chloroplatinic acid, immersing a nonconductive substrate in the chloroplatinic acid and adding formaldehyde to said chloroplatinic acid. The hydrophobically carbon black powder suspended in the chloroplatinic acid catalyzes and drives the reduction of platinum within the chloroplatinic acid toward the nonconductive substrate and reduces the chloroplatinic acid forming metallic platinum on the nonconductive substrate. In a preferred embodiment, a platinum deposit is formed on a glass substrate immersed in the chloroplatinic acid and the step of hydrophobically treating the carbon black powder is accomplished by adding a $CF_4$ gas plasma to the carbon black powder.

10 Claims, No Drawings

METHOD FOR FORMING A PLATINUM COATING ON NON-CODUCTIVE SUBSTRATES SUCH AS GLASS

GOVERNMENT INTEREST

The invention described herein may be manufactured, used and licensed by or for the Government of the United States of America without the payment to us of any royalties thereon.

FIELD OF THE INVENTION

The present invention relates in general to the field of optics and lasers, and more particularly to methods for making new and useful mirrors for lasers, protective coatings, corrosion prevention and electro-less plating on non-conductive substrates.

BACKGROUND OF THE INVENTION

Heretofore, in many applications it is desired that a thin, uniform layer or coating of platinum metal be deposited on various substrates because of platinum's well-known properties of having very good electrical conductivity, good corrosion resistance, a high melting point, and being both highly ductile and extremely malleable. Reasons for depositing platinum on a substrate include giving it special catalytic properties, or enhancing its electrical conductivity. Normally, platinum is deposited onto substrates by the vapor deposition technique.

In the prior art vapor deposition technique, a platinum sample in a vacuum oven is bombarded with electrons or other atomic particles, with the substrate being placed some distance away from the platinum source. As the platinum source is bombarded and platinum atoms are ejected from the sample, platinum atoms travel across the chamber, strike the substrate and are deposited on the substrate as metallic platinum.

The vapor deposition technique suffers from a number of drawbacks. That method requires an expensive high vacuum chamber. Additionally, much platinum is wasted when the platinum atoms are ejected from the source because the atoms spread out uniformly in all directions, including the chamber walls, and deposit on both the chamber walls and substrate. For these reasons, vapor deposition suffers from the limitations of high operational costs, the need for specialized equipment, generally poor adherence of deposited platinum to the substrate and being non-directional.

There is also a prior art aqueous method for deposition of platinum in which the substrate is placed in a solution containing platinum ions. Platinum ions in solution could, by reacting with a specific oxidizing agent, or electrons, be reduced to platinum metal directly on the desired substrate. This method would not waste as much platinum and would be less expensive. One use of the aqueous deposition method is passing electrical current through a chloroplatinic acid solution, to provide negatively charged electrons, which convert platinum ions in the +4 state into neutral, uncharged, metallic platinum. However, that method needs an electrically conductive substrate, and if the substrate is a nonconductive material such as glass, this method would not work.

The problems, drawbacks and limitations of the vapor deposition technique and the aqueous deposition procedure for conductive substrates can be overcome by a new procedure for depositing platinum. It is well-known that when formaldehyde is added to a chloroplatinic acid solution, platinum metal, in the form of small particles, can precipitate out of the solution. If a glass slide is placed in such a solution while formaldehyde is added, very little platinum sticks to the glass slide. If the solution of chloroplatinic acid also contains a suspension of carbon black powder, and then formaldehyde is added, platinum deposits primarily in, or on, the carbon black powder suspended in the solution. If a glass slide is present in this solution containing carbon black powder suspended in chloroplatinic acid, and then formaldehyde is added, the platinum deposits on the carbon black and not on the glass. These results and related findings are set forth in TABLE I, further below.

The present invention solves the non-directional and other drawbacks of the vapor and aqueous deposition techniques by providing a method for coating nonconductive substrates with platinum having the steps of immersing the substrate, such as a glass slide, in chloroplatinic acid also containing a suspension of carbon black powder treated to make it hydrophobic, thereby allowing the hydrophobic carbon powder to catalyze and drive the reduction of platinum towards the substrate so that the chloroplatinic acid then forms metallic platinum on the glass substrate, rather than on the carbon black powder. The method of the present invention is an effective, inexpensive and simplified procedure for platinizing nonconductive substrates that does not suffer from any of the disadvantages and limitations of other platinum deposition techniques. Although the inventors have discovered the advantages of this technique by immersing a glass slide in the requisite solution, these results should also be achieved for other nonconductive substrates, therefore any nonconductive substrate is considered within the scope of this disclosure and the appended claims.

The following definition should be considered applicable to this invention:

"hydrophobically treated" is defined as treatment of carbon black powder with either $CF_4$ gas plasma or any other gas plasma or chemical treatment that renders the carbon black powder more water repellent.

SUMMARY OF THE INVENTION

The general object of the method of the present invention is to solve the non-directional drawback of the aqueous platinum deposition technique using chloroplatinic acid and hydrophobically treated carbon black powder. It is another object of the method of the present invention to immerse a nonconductive substrate in chloroplatinic acid also containing a suspension of carbon black powder that has been specifically treated to be hydrophobic. A more particular object of the method of this invention is to immerse a glass substrate for coating in a specific direction in chloroplatinic acid also containing a suspension of carbon black powder treated to be hydrophobic. A further object of the method of this invention is to immerse a substrate for coating in a specific direction in chloroplatinic acid containing a suspension of carbon black powder, treated to be hydrophobic, which catalyzes and drives the reduction of platinum towards the substrate so that the chloroplatinic acid is then reduced in the usual manner, forming metallic platinum on the substrate.

It has now been found that the aforementioned objects can be attained with a method providing the steps of forming chloroplatinic acid having a suspension of hydrophobic carbon black powder, immersing a nonconductive substrate, such as a glass slide, in said chloroplatinic acid, said hydrophobic carbon black powder catalyzing and driving the reduction of platinum toward said nonconductive substrate, reducing said chloroplatinic acid and forming metallic platinum, which solves the non-directional drawback of the aqueous deposition technique without suffering from any of the disadvantages, drawbacks and limitations of other platinum deposition techniques.

No drawings are considered necessary for this invention. Other features and details of the present invention will become apparent in light of the Detailed Description of the Preferred and Other Embodiments of the present invention along with the accompanying TABLE I.

TABLE I depicts the results of reducing chloroplatinic acid to platinum onto a glass slide by adding formaldehyde. The chloroplatinic acid contains a glass slide and either no carbon, ordinary carbon black, or carbon black treated to be hydrophobic.

DETAILED DESCRIPTION OF THE PREFERRED AND OTHER EMBODIMENTS

As described in the Background of the Invention, those concerned with the aqueous deposition method's non-directional drawback, have long recognized the need for a technique that deposits platinum metal only on a specific location. The method of present invention solves the non-directional drawback of the aqueous deposition technique without suffering from any of the disadvantages and limitations of other platinum deposition techniques and is used for coating or plating nonconductive substrates with platinum.

The present invention addresses the long-felt need for greater platinum deposition specificity by providing a method for immersion of nonconductive substrates, such as a glass slide, in chloroplatinic acid having a suspension of hydrophobically treated carbon black powder. The general formula for platinization by forming metallic platinum on materials when using chloroplatinic acid is:

$$Pt\ (+4)+4e(-)\rightarrow Pt(0)$$

In this formula, platinum ions (indicated as a Pt atom that is missing 4 negatively charged electrons, which means that the platinum ion has a positive charge) reacts or combines with 4 electrons to become uncharged, metallic platinum. The 4 positive charges and 4 negative charges cancel each other out and neutral platinum remains. Essentially, this procedure gives back to the platinum ions the same number of electrons that had been previously lost.

Based on this formula, it is also noted that the prior art aqueous deposition technique utilizing a chloroplatinic acid solution and passing electrical current through it provides negatively charged electrons, which convert platinum ions in the +4 state into the neutral, uncharged, metallic state. Inasmuch as that method requires an electrically conductive substrate and a source of electrons, i.e. a battery, that method would not work in numerous situations where a nonconductive substrate, such as glass, needs to have platinum deposited on it.

The method of the present invention for forming a platinum deposit on a nonconductive substrate comprises the steps of first hydrophobically treating a carbon black powder, then forming a solution of chloroplatinic acid, suspending said hydrophobically treated carbon black powder in said chloroplatinic acid, immersing a nonconductive substrate in said chloroplatinic acid, adding formaldehyde to said chloroplatinic acid, said hydrophobically carbon black powder suspended in the chloroplatinic acid catalyzes and drives the reduction of platinum within said chloroplatinic acid toward said nonconductive substrate and reducing said chloroplatinic acid in order to form metallic platinum on said nonconductive substrate.

The preferred embodiment of the method of the present invention provides for forming a platinum deposit on a glass substrate comprising the steps of hydrophobically treating a carbon black powder by adding a $CF_4$ gas plasma to said carbon black powder, forming a chloroplatinic acid solution, suspending said hydrophobically treated carbon black powder in said chloroplatinic acid, immersing a glass substrate in said chloroplatinic acid, adding formaldehyde to said chloroplatinic acid, said hydrophobically treated carbon black powder in said chloroplatinic acid catalyzes and drives the reduction of platinum within said chloroplatinic acid toward said glass substrate and reducing said chloroplatinic acid in order to form metallic platinum on said glass substrate.

An example of the preferred embodiment of present invention's method may be realized by placing a carbon black powder, such as Vulcan XC-72, in a gas plasma reactor. The chamber is evacuated and backfilled with a reduced pressure of a gas that will cause the treated surface to become water repellent, the experiment will work particularly well if the gas that is used to backfill is $CF_4$. Once the chamber is filled with $CF_4$, the microwave generator is turned on and a gas plasma forms inside the chamber. The gas plasma reacts with the carbon black and modifies its surfaces forming a carbon black which is now more hydrophobic than before. 4 grams of this treated carbon black was mixed with 2.6 grams of chloroplatinic acid in 300 ml. of water. Carbon black does not dissolve in water or the aqueous chloroplatinic acid solution and instead remains suspended in the solution. A glass slide is then immersed in the above aqueous chloroplatinic acid solution containing the suspended carbon black powder. Then, approximately 5 ml. of formaldehyde is slowly added to this solution. The color of the chloroplatinic acid solution changes from yellow to clear, indicating that platinum ions have been depleted from the solution. The glass slide turns silver, indicating that the platinum has deposited on the glass slide. X-ray diffraction experiments on the carbon indicates that very little platinum was deposited in the carbon black powder. If formaldehyde was added to a chloroplatinic acid solution that did not contain gas plasma-treated carbon suspended in it, i.e. either by not adding any carbon black powder to the chloroplatinic acid, or by using suspended untreated carbon black powder instead of gas plasma-treated carbon black powder, metallic platinum would not deposit on the glass slide.

In the methods of the present invention, the function of the hydrophobically treated carbon powder is to catalyze and drive the reduction of platinum towards the substrate surface so that the chloroplatinic acid is then reduced in the usual way, forming metallic platinum. Hydrophobic carbon black powder is water repellant so that when formaldehyde is added to the chloroplatinic acid, platinum deposits primarily onto the substrate with a small amount on the carbon black powder. TABLE I below provides the results of adding formaldehyde to chloroplatinic acid solution to reduce platinum using a glass slide.

TABLE I

RESULTS OF ADDING FORMALDEHYDE TO CHLOROPLATINIC ACID SOLUTION TO REDUCE PLATINUM USING GLASS SLIDE

| SOLUTION COMPOSITION | RESULTS |
|---|---|
| A. No carbon black powder suspended in chloroplatinic acid solution | No reaction |
| B. Untreated carbon black powder suspended in chloroplatinic acid solution | No deposit on glass slide, platinum deposits on/on carbon black powder |
| C. Gas-plasma treated carbon black powder suspended in chloroplatinic acid solution | platinum deposits mostly on glass slide surface |

Referring now to TABLE I, above, if no carbon black is present during the platinum reduction step, then no reaction will occur, depicted in Solution Composition A. In Solution Composition B, if ordinary, untreated carbon black powder is used instead of hydrophobically treated carbon black, metallic platinum deposits on the carbon black powder rather than on the glass slide. It is noted that the Solution Composition method B is non-directional, meaning that platinum deposits wherever the solution contacts carbon powder surfaces. Only when carbon black powder treated to be hydrophobic is present in the chloroplatinic acid, as depicted in Solution Composition C, will good platinum coating occur.

The critical factor in the methods of the present invention is the choice of carbon black. Not all carbon blacks will work—only hydrophobic carbons appear to work. As demonstrated in TABLE I, above, if a nonconductive substrate, such as a glass slide, is placed in a solution of chloroplatinic acid in which ordinary carbon black powder, which is wetted by chloroplatinic acid solution, is suspended, and one attempts to reduce chloroplatinic acid with formaldehyde, very little, if any, platinum will deposit on the glass substrate. In order for platinum to be deposited on the glass substrate, the carbon black powder must be deliberately made hydrophobic, by treatment with a $CF_4$ gas plasma, or any other gas plasma or chemical treatment that renders the carbon black powder more water repellent, including ether, so that during reduction of chloroplatinic acid with formaldehyde, platinum ions in solution will be repelled by the suspended carbon black, and reduced, resulting in metallic platinum being dispersed on the substrate.

Other embodiments of the method of the present invention include employing variations such as utilizing a nonconductive substrate having at least one easily wettable surface, utilizing a glass surface as a nonconductive substrate and using an ether gas plasma or other hydrophobic chemicals, rather than $CF_4$ gas plasma, to make the carbon black powder water repellent during said hydrophobic treating step.

Of course, it should be understood that the foregoing disclosure relates to only a small number of preferred embodiments and examples of the method of the present invention and that numerous modifications or alterations may be made therein without departing from the spirit and scope of the invention as set forth in the foregoing disclosure and the appended claims.

What we claim is:

1. A method of forming a platinum deposit on a nonconductive substrate, comprising the steps of:

hydrophobically treating a carbon black powder;

forming chloroplatinic acid;

suspending said hydrophobically treated carbon black powder in said chloroplatinic acid;

immersing said nonconductive substrate in said chloroplatinic acid;

adding formaldehyde to said chloroplatinic acid;

said hydrophobically treated carbon black powder catalyzing and driving the reduction of platinum within said chloroplatinic acid toward said nonconductive substrate; and reducing said chloroplatinic acid to form metallic platinum on said nonconductive substrate.

2. The method of forming a platinum deposit on a nonconductive substrate, as recited in claim 1, wherein said hydrophobic treatment step comprises treating said carbon black powder with a $CF_4$ gas plasma.

3. The method of forming a platinum deposit on a nonconductive substrate, as recited in claim 2, wherein said nonconductive substrate includes at least one wettable surface.

4. The method of forming a platinum deposit on a nonconductive substrate, as recited in claim 3, wherein said nonconductive substrate is a glass substrate.

5. The method of forming a platinum deposit on a nonconductive substrate, as recited in claim 4, wherein said glass substrate is a glass slide.

6. The method of forming a platinum deposit on a nonconductive substrate, as recited in claim 3, wherein said nonconductive substrate is a silicon wafer.

7. The method of forming a platinum deposit on a nonconductive substrate, as recited in claim 1, wherein said hydrophobic treatment step comprises treating said carbon black powder with an ether gas plasma.

8. A method of forming a platinum deposit on a glass substrate, comprising the steps of:

hydrophobically treating a carbon black powder with a $CF_4$ gas plasma;

forming chloroplatinic acid;

suspending said hydrophobically treated carbon black powder in said chloroplatinic acid;

immersing said glass substrate in said chloroplatinic acid;

adding formaldehyde to said chloroplatinic acid;

said hydrophobically carbon black powder catalyzing and driving the reduction of platinum within said chloroplatinic acid toward said glass substrate; and reducing said chloroplatinic acid to form metallic platinum on said glass substrate.

9. The method of forming a platinum deposit on a glass substrate, as recited in claim 8, wherein said glass substrate is a glass slide.

10. The method of forming a platinum deposit on a glass substrate, as recited in claim 8, wherein said hydrophobic treatment step comprises treating said carbon black powder with an ether gas plasma.

* * * * *